US008631854B2

(12) United States Patent
Dratva et al.

(10) Patent No.: US 8,631,854 B2
(45) Date of Patent: Jan. 21, 2014

(54) CONTINUOUS CASTING METHOD AND APPARATUS FOR PRODUCING PRELIMINARY PROFILES, IN PARTICULAR DOUBLE T PRELIMINARY PROFILES

(75) Inventors: Christian Dratva, Zurich (CH); Klaus Von Eynatten, Zurich (CH)

(73) Assignee: SMS Concast AG, Zurich (CH)

( * ) Notice: Subject to any disclaimer, the term of this patent is extended or adjusted under 35 U.S.C. 154(b) by 159 days.

(21) Appl. No.: 12/717,992

(22) Filed: Mar. 5, 2010

(65) Prior Publication Data

US 2010/0270000 A1 Oct. 28, 2010

(30) Foreign Application Priority Data

Mar. 7, 2009 (EP) ..... 09003346

(51) Int. Cl.
*B22D 11/124* (2006.01)

(52) U.S. Cl.
USPC ..... 164/486; 164/485; 164/443; 164/444; 164/5

(58) Field of Classification Search
USPC ..... 164/5, 443, 444, 485, 486
See application file for complete search history.

(56) References Cited

U.S. PATENT DOCUMENTS

| | | | | |
|---|---|---|---|---|
| 3,656,536 | A * | 4/1972 | Colombo | 164/486 |
| 6,904,953 | B2 * | 6/2005 | Frick et al. | 164/444 |
| 2004/0255987 | A1 | 12/2004 | Schneider | |
| 2005/0211413 | A1 * | 9/2005 | Letzel et al. | 164/486 |

FOREIGN PATENT DOCUMENTS

| | | | |
|---|---|---|---|
| JP | 09174210 | A * | 7/1997 |
| JP | 2008100253 | A * | 5/2008 |

OTHER PUBLICATIONS

JPO machine translation of JP 09174210 A, Jul. 8, 1997.*
JPO machine translation of JP 2008100253 A, May 1, 2008.*

* cited by examiner

*Primary Examiner* — Keith Walker
*Assistant Examiner* — Kevin E Yoon
(74) *Attorney, Agent, or Firm* — Brian Roffe

(57) ABSTRACT

With a continuous casting method for producing preliminary profiles, in particular double T preliminary profiles, the downwardly flowing cooling water is pushed out of the internal curve of the preliminary profile strand (3) via the profile flanges and discharged using water nozzles (21, 22) aligned substantially to the crossover from the bar (4) to the respective flange (5, 6) by means of the diverting water delivered via the water nozzles (21, 22). In this way the excessive cooling caused by downwardly running cooling water is largely avoided in the internal curve of the preliminary profile strand.

20 Claims, 3 Drawing Sheets

CONTINUOUS CASTING METHOD AND APPARATUS FOR PRODUCING PRELIMINARY PROFILES, IN PARTICULAR DOUBLE T PRELIMINARY PROFILES

FIELD OF THE INVENTION

The invention relates to a continuous casting method for producing preliminary profiles, in particular double T preliminary profiles, wherein cooling water running off in an internal curve of the preliminary profile strand, which has a bar and two side flanges, is discharged, and specifically, the cooling water in a region of a curved strand guide of the preliminary profile strand is discharged therefrom, and to an apparatus for implementing the method which serves to discharge cooling water running off from an internal curve of a preliminary profile strand produced by curved continuous casting and which has a bar and two side flanges and is guided through a curved strand guide.

BACKGROUND OF THE INVENTION

With curved continuous casting of preliminary profiles, in particular double T preliminary profiles or beam blank preliminary profile strands which have a bar and two side flanges, the cooling water is collected between the flanges on the inside of the radius in the preliminary profile strand and can only run off downwards along the preliminary profile strand. The cooling water must be removed from the internal curve before the gas cutting of the preliminary profile strand so that cutting is actually possible. In addition, the downwardly running cooling water results in excessive cooling in the profile flanges. Due to this cracks can occur in the strand when aligning the latter. Due to the stronger cooling of the inside of the profile the material contracts more strongly here than on the outside of the profile, due to which the radius wants to be reduced. The effect of this change to the radius is additional loading of the guide rollers on the inside.

As disclosed, for example, in EP 1 497 056 B 1, it is known to draw off the cooling water in the region of the curved strand guide of the preliminary profile strand from the internal curve of the profile or to blow it off by means of compressed air. With all of these methods it is difficult to come sufficiently close to the preliminary profile strand in order to produce a sufficiently good water seal. The use of compressed air blown into the gap in order to improve the seal brings about additional strong cooling, which is undesirable. Moreover, the amount of compressed air required is costly for the operator.

OBJECTS AND SUMMARY OF THE INVENTION

The object forming the basis of the present invention is to propose a commercially advantageous method of the type specified at the start and to provide an apparatus for implementing the method, with which the excessive cooling in the internal curve of the preliminary profile strand can largely be avoided.

This object is achieved according to the invention by a method wherein the downwardly flowing cooling water is pushed out of the internal curve of the preliminary profile strand via the profile flanges and discharged using water nozzles aligned substantially to the crossover from the bar to the respective flange by means of the diverting water delivered via the water nozzles, and by an apparatus wherein, disposed in a region of a curved strand guide, are water nozzles for delivering diverting water into the internal curve of the preliminary profile strand which are aligned substantially to the crossover from the bar to the respective flange of the preliminary profile strand, and which are provided for pushing the downwardly flowing cooling water out of the internal curve of the preliminary profile strand.

Preferred further embodiments of the method according to the invention and of the apparatus according to the invention form the subject matter of the dependent claims.

With the method according to the invention and the apparatus according to the invention the excessive cooling caused by downwardly running cooling water can be largely avoided in the inner curve of the preliminary profile strand, only water nozzles being used. Neither additional baffle plates or funnels in the shoulder region, i.e. between the side flanges and the bar of the preliminary profile, nor compressed air is required. The associated installations and operating costs are therefore also dispensed with.

The additional cooling effect provided by the diverting water can be compensated by the reduction of the cooling water. In order to reduce the undercooling, heated diverting water can be used.

With the method according to the invention the cooling of the preliminary profile strand can be effected by adjusting the diverting water temperature.

BRIEF DESCRIPTION OF THE DRAWINGS

In the following the invention is described in greater detail by means of the drawings. These show as follows.

DETAILED DESCRIPTION OF THE INVENTION

Figure 1:
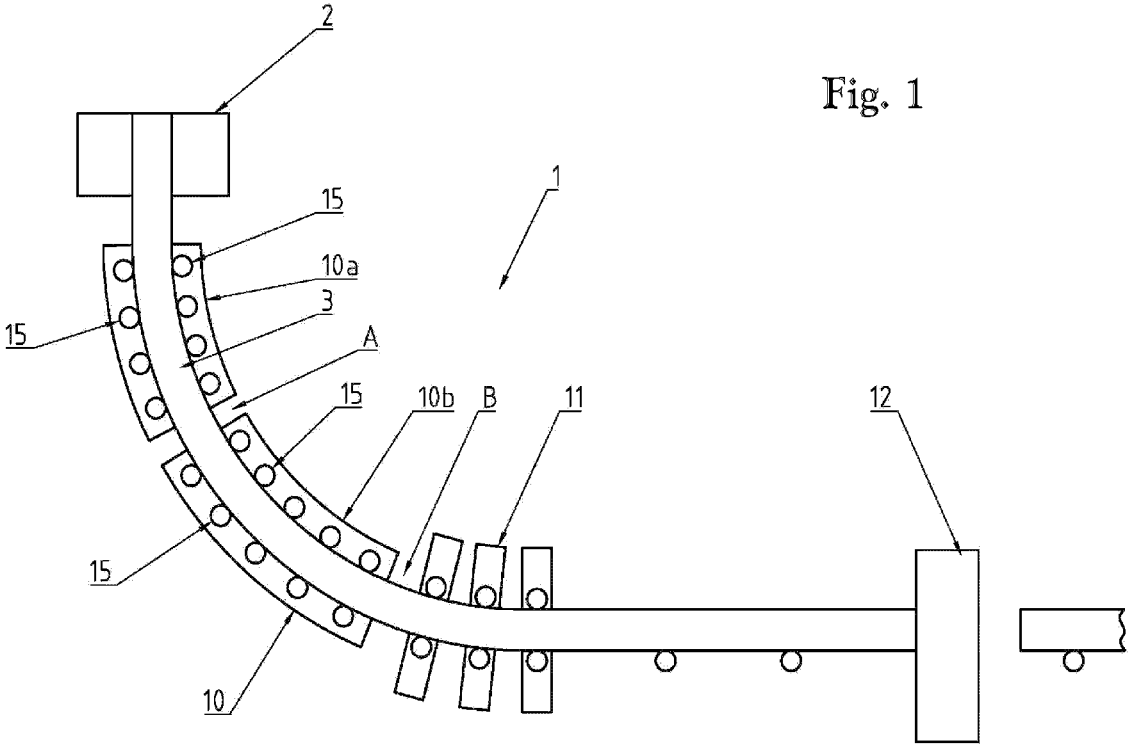
FIG. 1 is a diagrammatic side view of a continuous casting plant for the continuous casting of a beam blank preliminary profile strand.

FIG. 1 shows a continuous casting plant 1 having a water-cooled mould 2, from which the liquid metal, in particular steel, is continuously conveyed away forming a shell as a casting strand. The casting strand is a preliminary profile, in particular a double T preliminary profile 3, the cross-section of which can be seen in FIGS. 2 and 3, and which has a bar 4 and two side flanges 5, 6. The solidification of an outer, solid strand shell takes place already in the mould 2 (primary cooling).

The preliminary profile strand 3 passing vertically out of the mould 2 is guided through a curved strand guide 10 and bent into the horizontal. Aligned by an aligning unit 11 it passes to a gas cutting machine 12. The strand guide 10 comprises a number of strand guide segments and modules 10*a*, 10*b* disposed one behind the other (two are indicated in FIG. 1) of which at least the first segment 10*a* adjacent to the mould 2 comprises in addition to guide rollers 15 spray nozzles 16 (FIG. 2) for delivering cooling water, by means of which so-called secondary cooling of the preliminary profile strand 3 takes place.

Figure 2:
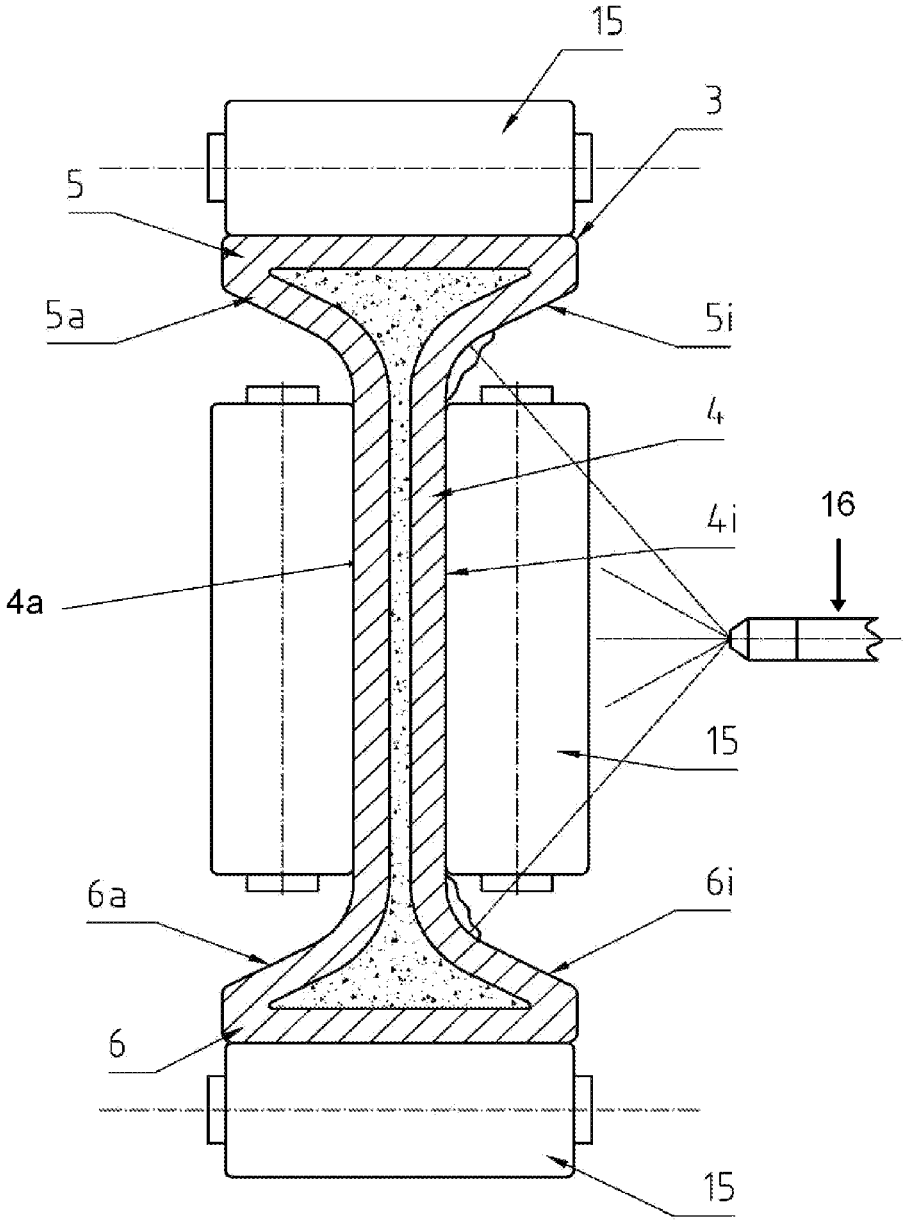
FIG. 2 is a diagrammatic cross-section of the preliminary profile strand within a water-cooled region of a curved strand guide.
Figure 3:
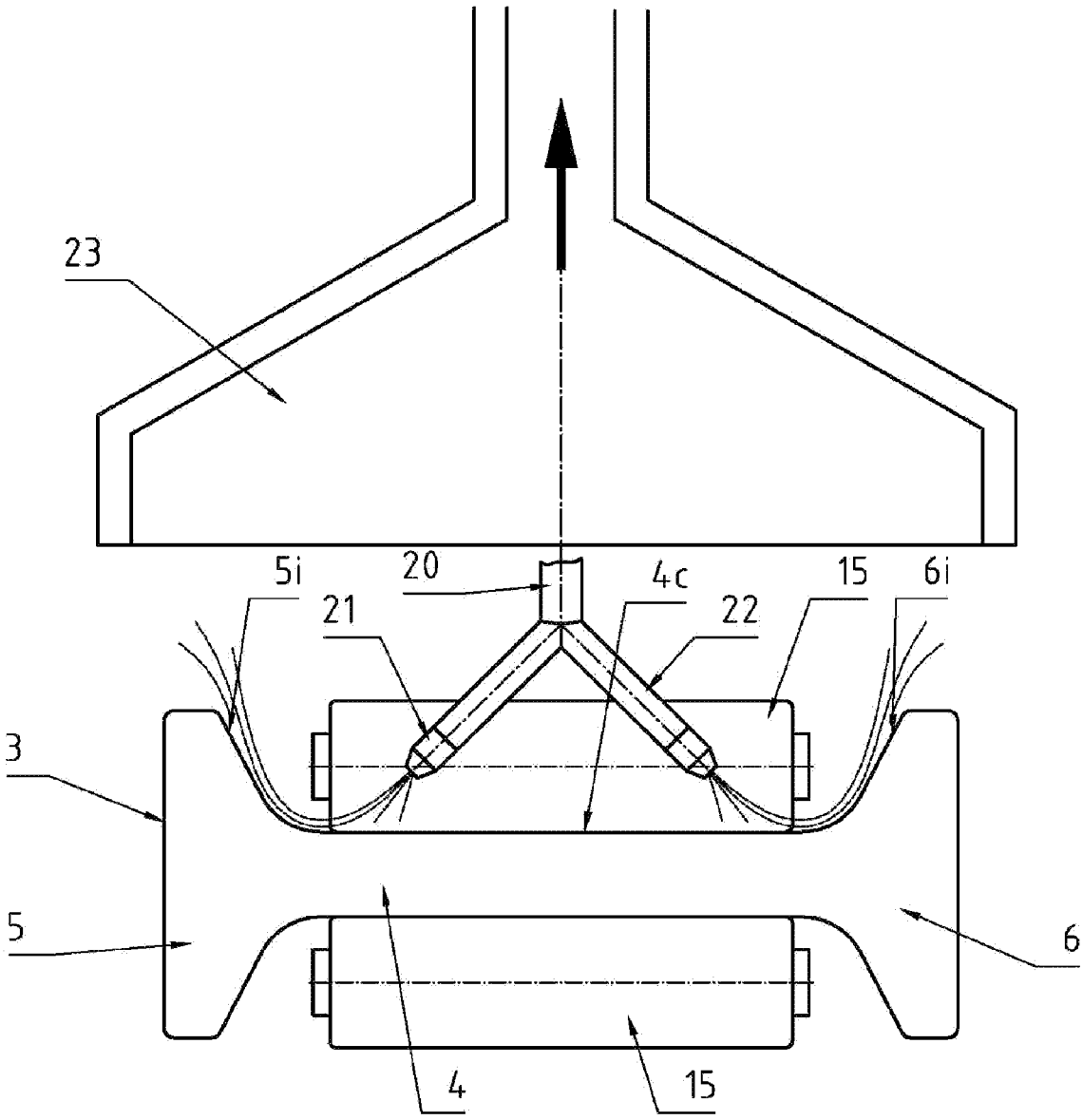
FIG. 3 is a diagrammatic cross-section of the preliminary profile strand in the region of an apparatus according to the invention for discharging cooling water running out from the internal curve of the preliminary profile strand.

Whereas the cooling water can flow away downwards without any problem away from the preliminary profile strand 3 from the outside (from the bar side 4*a* and from flange parts 5*a*, 6*a* according to FIG. 2) of the preliminary profile strand 3 produced in a casting radius, the cooling water remains collected on the inside, in the internal curve of the preliminary profile strand 3 defined by the bar side 4*i* and by flange parts 5*i*, 6*i*, in particular in the crossover region between the bar 4 and the respective flange 5, 6 or flange part 5*i*, 6*i*, as indicated in FIG. 2, and tends to run off downwards towards the gas cutting machine 12. In order to prevent this, according to the invention—after the cooling water has fulfilled the desired function of the secondary cooling—by means of water nozzles 21, 22 that can be seen in FIG. 3, diverting water is injected into the internal curve of the preliminary profile strand 3, and the cooling water is thus pushed out of the internal curve. The diverting water produces an impulse onto the downwardly flowing cooling water. The water nozzles 21, 22 are substantially aligned to the crossover from the bar 4 to the respective flange 5, 6 so that the cooling water is diverted via the profile flanges 5, 6 and their flange parts 5*i*, 6*i* and collected together with diverting water by a collecting apparatus 23 and discharged by the latter. Collecting apparatus 23 is arranged on a side of the internal curve of the preliminary profile strand 3 as shown in FIG. 3, i.e., above the preliminary profile strand 3.

The two water nozzles 21, 22 are preferably connected to a common water attachment 20. For better squirting of the internal curve of the profile, they can advantageously be disposed such as to be moveable to and fro laterally to the side flanges 5, 6.

The water nozzles with the diverting water are advantageously already used in the initial, substantially still vertical region of the curved strand guide 10 and disposed, for example, in the region between the two first strand guide segments and modules 10*a*, 10*b* (indicated by arrow A in FIG. 1). The water nozzles 21, 22 preferably lying in a common plane are then aligned at a pre-specified angle to the curve tangent.

However, it is also possible to dispose the water nozzles 21, 22 in approximately the central region of the curved strand guide 10, e.g. after the second strand guide segment 10*b* according to FIG. 1. The diverting water is then introduced into the internal curve of the preliminary profile strand 3 at an angle to the curve tangent (indicated by arrow B in FIG. 1).

Needless to say, the water nozzles 21, 22 or a plane common to the two water nozzles 21, 22 could also enclose an angle of between 0° and 90°.

With the method according to the invention and the apparatus according to the invention the excessive cooling caused by downwardly running cooling water can largely be avoided in the internal curve of the preliminary profile strand, only water nozzles being used. Neither additional baffle plates or funnels in the shoulder region, i.e. between the side flanges of the preliminary profile, nor compressed air is required. Therefore, the associated installations and operating costs are also dispensed with. The water used in any event in this region is available free of charge. The diverting apparatus is located outside of the shoulder region, and so there can be no collision between the casting strand and the diverting apparatus.

The additional cooling effect due to the diverting water can be compensated by reducing the downwardly flowing cooling water. In order to reduce the undercooling, heated diverting water can be used.

With the method according to the invention the cooling of the preliminary profile strand can be advantageously effected by adjusting the diverting water temperature.

The invention claimed is:

1. In a continuous casting method for producing preliminary profiles, in which a preliminary profile strand is guided through a curved strand guide and cooling water is applied to the preliminary profile strand as it is guided through the curved strand guide, the preliminary profile strand having a cross-sectional shape including a bar and two side flanges, the method comprising:

directing diverting water from a first water nozzle against an internal curve of the preliminary profile strand and at a first crossover region from the bar to a first one of the side flanges of the preliminary profile strand, the first nozzle being oriented to have an outlet portion at a first end that is more proximate the first crossover region than a remaining portion of the first nozzle and the remaining portion of the first nozzle including a second end opposite the first end and being more proximate a center of the bar than the outlet portion of the first nozzle, and the first nozzle being in alignment with the first crossover region such that the diverting water being directed from the first nozzle pushes the cooling water out of the first crossover region of the preliminary profile strand via the first side flange of the preliminary profile strand;

directing diverting water from a second water nozzle against the internal curve of the preliminary profile strand and at a second crossover region from the bar to a second one of the side flanges of the preliminary profile strand opposite the first side flange, the second nozzle being oriented to have an outlet portion at a first end that is more proximate the second crossover region than a remaining portion of the second nozzle and the remaining portion of the second nozzle including a second end opposite the first end and being more proximate the center of the bar than the outlet portion of the second nozzle, and the second nozzle being in alignment with the second crossover region such that the diverting water being directed from the second nozzle pushes the cooling water out of the second crossover region of the preliminary profile strand via the second side flange of the preliminary profile strand; and collecting cooling water pushed out of the internal curve of the preliminary profile strand and diverting water directed against the internal curve of the preliminary profile strand by means of a collecting apparatus arranged above the internal curve of the preliminary profile strand.

2. The method of claim 1, further comprising discharging the cooling water and the diverting water collected by the collecting apparatus therefrom.

3. The method of claim 1, further comprising connecting the water nozzles to a common water attachment.

4. The method of claim 1, further comprising arranging the water nozzles to be movable laterally relative to the flanges of the preliminary profile strand.

5. The method of claim 1, wherein the water nozzles are arranged on a side of the internal curve of the preliminary profile strand and alongside a substantially vertical portion of the curved strand guide.

6. The method of claim 1, wherein the water nozzles are arranged on a side of the internal curve of the preliminary profile strand and alongside an approximately central region of the curved strand guide between an initial vertical portion and a terminal portion thereof.

7. The method of claim 1, wherein the water nozzles are arranged on a side of the internal curve of the preliminary profile strand and alongside an approximately central region of the curved strand guide between an initial vertical portion and a terminal portion thereof and at an angle of approximately 45° to a tangent of a curve of the preliminary strand profile.

8. The method of claim 1, further comprising providing strand guide segments and modules along the curved strand guide separated from one another, the water nozzles being arranged between two adjacent ones of the strand guide segments and modules.

9. The method of claim 8, wherein the water nozzles are arranged on a side of the internal curve of the preliminary profile strand and alongside an approximately central region of the curved strand guide between an initial vertical portion and a terminal portion thereof.

10. The method of claim 1, wherein the water nozzles are positioned to lie in a common plane.

11. The method of claim 10, further comprising aligning the water nozzles at a pre-specified angle to a tangent of a curve of the preliminary strand profile.

12. The method of claim 1, further comprising providing strand guide segments and modules along the curved strand guide separated from one another, the water nozzles being arranged on a side of the internal curve of the preliminary profile strand after a downstream one of the strand guide segments and modules.

13. The method of claim 1, further comprising:

providing strand guide segments and modules along the curved strand guide; and providing an aligning unit downstream of the strand guide segments and modules, the water nozzles being arranged on a side of the internal curve of the preliminary profile strand and between the aligning unit and an adjacent one of the strand guide segments and modules.

14. The method of claim 1, further comprising compensating for an additional cooling effect brought about by the diverting water by reducing the flow of cooling water.

15. The method of claim 1, further comprising heating the diverting water before directing it against the internal curve of the preliminary profile strand.

16. The method of claim 15, further comprising adjusting cooling of the preliminary profile strand by adjusting a temperature to which the diverting water is heated.

17. The method of claim 1, wherein the preliminary profile strands are double T preliminary profile strands.

18. The method of claim 1, wherein the water nozzles are arranged above the internal curve of the preliminary profile strand and alongside an at least partly vertical portion of the curved strand guide, the first and second nozzles being positioned after a guide roller in a direction of movement of the preliminary profile strand such that the guide roller prevents cooling water from flowing along the bar of the preliminary profile strand and causes cooling water to flow into and downwardly along the first and second crossover regions and first and second side flanges of the preliminary profile strand;

the first nozzle aligning with the first crossover region after the guide roller such that the water directed from the first nozzle diverts the downwardly flowing cooling water by changing a flow direction of the downwardly flowing cooling water and causes the diverted water to flow out of the first crossover region of the preliminary profile strand and over the first side flange of the preliminary profile strand;

the second nozzle aligning with the second crossover region after the guide roller such that the water directed from the second nozzle diverts the downwardly flowing cooling water by changing a flow direction of the downwardly flowing cooling water and causes the diverted water to flow out of the second crossover region of the preliminary profile strand over the second side flange of the preliminary profile strand.

19. The method of claim 1, wherein the second ends of the first and second water nozzles are connected to a common inlet water attachment situated between the outlet portions of the first and second water nozzles.

20. The method of claim 1, wherein the collecting apparatus has an inlet for the cooling water and the diverting water arranged entirely above the internal curve of the preliminary profile strand and that extends over both the first and second side flanges.

* * * * *